US010272703B2

(12) United States Patent
Okawa et al.

(10) Patent No.: US 10,272,703 B2
(45) Date of Patent: Apr. 30, 2019

(54) PRINTING APPARATUS

(71) Applicant: SEIKO EPSON CORPORATION, Tokyo (JP)

(72) Inventors: Soshi Okawa, Shiojiri (JP); Kazuhiro Nishiyama, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/846,068

(22) Filed: Dec. 18, 2017

(65) Prior Publication Data

US 2018/0178560 A1 Jun. 28, 2018

(30) Foreign Application Priority Data

Dec. 27, 2016 (JP) ..... 2016-254410

(51) Int. Cl.

| | |
|---|---|
| ***B65H 3/06*** | (2006.01) |
| ***B65H 5/06*** | (2006.01) |
| ***B41J 13/10*** | (2006.01) |
| ***B65H 1/12*** | (2006.01) |
| ***B65H 1/26*** | (2006.01) |

(52) U.S. Cl.

CPC ..... *B41J 13/103* (2013.01); *B65H 1/12* (2013.01); *B65H 1/266* (2013.01); *B65H 3/06* (2013.01); *B65H 5/068* (2013.01); *B65H 2405/1117* (2013.01); *B65H 2405/32* (2013.01); *B65H 2405/353* (2013.01)

(58) Field of Classification Search

CPC ..... B41J 13/103; B65H 3/06; B65H 5/068
USPC ..... 347/104
See application file for complete search history.

(56) References Cited

U.S. PATENT DOCUMENTS

2015/0061213 A1* 3/2015 Masubuchi ..... B65H 1/266 271/117

FOREIGN PATENT DOCUMENTS

JP 2015-093762 5/2015

* cited by examiner

*Primary Examiner* — Huan H Tran
*Assistant Examiner* — Alexander D Shenderov
(74) *Attorney, Agent, or Firm* — Workman Nydegger

(57) ABSTRACT

A printing apparatus that enables a medium container to be detached by moving a hopper with a reduced load with a simple structure is provided.

4 Claims, 5 Drawing Sheets

PRINTING APPARATUS

BACKGROUND

1. Technical Field

The present invention relates to a printing apparatus, for example, an ink jet printer.

2. Related Art

As an example printing apparatus, an ink jet printer that performs recording by ejecting an ink, which is an example liquid, onto a medium, which is an example medium, is known. Such a printer typically includes a cassette (medium container) that is detachably attached to an apparatus body and a pickup roller for feeding a medium stored in the cassette. The cassette includes a lift plate (hopper) that presses paper sheets stored in the cassette against the pickup roller. When the cassette is attached to the apparatus body, it is preferable that the lift plate be located at an upper position to press the paper sheets stored in the cassette against the pickup roller and when the cassette is detached from the apparatus, it is preferable that the lift plate be located at a lower position so that the medium stored in the cassette does not interfere with the other members. To achieve this, JP-A-2015-93762 describes a printer that controls a position of a lift plate by using a position control unit and a drive motor.

The printer described in JP-A-2015-93762 moves the lift plate upward and downward by using the position control unit and the drive motor, however, such a structure for moving the lift plate is complicated.

SUMMARY

An advantage of some aspects of the invention is that there is provided a printing apparatus that enables a cassette to be detached by moving a hopper with a reduced load with a simple structure.

Hereinafter, an apparatus for solving the above-mentioned problem and its operational advantages will be described. A printing apparatus for solving the above-mentioned problem includes an apparatus body, a print section configured to perform printing on a medium, a medium container that is detachably attached to the apparatus body, the medium container being capable of storing the medium, and a pickup roller configured to come into contact with the medium when the medium is fed from the medium container attached to the apparatus body. The medium container can be detached by being pulled out from the apparatus body to a side closer to a user and includes a hopper configured to press the stored medium against the pickup roller. The hopper is turned on a portion on the side closer to the user as a fulcrum with respect to the direction of detachment from the apparatus body and is pressed by a pressing member against the pickup roller such that a portion on a side farther from the user is lifted with respect to the detachment direction. The apparatus body includes a guide surface with which a part of the hopper comes into contact, the guide surface being configured to press down the hopper against the pressure by the pressing member as the medium container attached to the apparatus body is detached from the apparatus body. The guide surface extends in such a manner that a downward angle is formed toward the side closer to the user.

With this structure, when a medium container is detached from an apparatus body to a side closer to a user, a portion of a hopper on a side farther from the user than a fulcrum of the hopper comes into contact with a guide surface from the side farther from the user and the portion of the hopper slides on the guide surface while the medium container is detached. Consequently, as the medium container is pulled out from the apparatus body toward the side closer to the user, the hopper can be moved downward against an urging force of an urging member by the guide surface that makes a downward acute angle toward the side closer to the user with respect to the detachment direction. With this structure, the load applied to the moving hopper when the medium container is detached can be reduced with the simple structure.

In this printing apparatus, it is preferable that the guide surface be provided in such a manner that angles with respect to the detachment direction are decreased from the side farther from the user toward the side closer to the user in the detachment direction.

In general, an urging member (pressing member) made of a spring, a rubber or the like has a larger urging force (reaction force) as the compression amount increases. In this printing apparatus, as the medium container is pulled out from the apparatus body, the position of the hopper is lowered and this causes the urging member to increase its compressing force and thereby the urging force increases. As the urging force of the urging member increases, a larger force is required to lower the hopper. Consequently, the force required to detach the medium container gradually increases as the amount of detachment increases.

To address the problem, the above-described structure enables the tip portion of the hopper to be quickly and greatly lowered at a predetermined force at the stage where the urging force of the urging member is relatively small and the detachment amount of the medium container is small. On the other hand, the tip portion of the hopper can be slowly lowered by the same degree of force as the predetermined force at the stage where the urging force of the urging member is relatively large and the detachment amount of the medium container is large. In short, the force required to detach the medium container can be smoothed.

In this printing apparatus, even if the angles of the guide surface with respect to the detachment direction is evenly moderated from the end portion on the side farther from the user toward the end portion on the side closer to the user in the detachment direction, it is possible to prevent a sudden increase in the force required to detach the medium container. In such a case, the stroke required to detach the medium container from the apparatus body becomes long. However, with the above-described structure, it is not necessary to provide such a long stroke for detachment.

In this printing apparatus, it is preferable that the guide surface be provided in such a manner that angles with respect to the detachment direction are gradually decreased.

With this structure, the force required to detach the medium container can be further smoothed.

In this printing apparatus, it is preferable that the guide surface include continuous planes.

With this structure, the guide surface can be formed more easily than the arc-shaped guide surface.

In this printing apparatus, it is preferable that the hopper have edge portions that can be brought into contact with the guide surface at both ends in a width direction that is different from the detachment direction and a length direction, and the edge portions have curved sections at the portions to be brought into contact with the guide surface.

With this structure, the friction produced when the edge portions come into contact with the guide surface can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
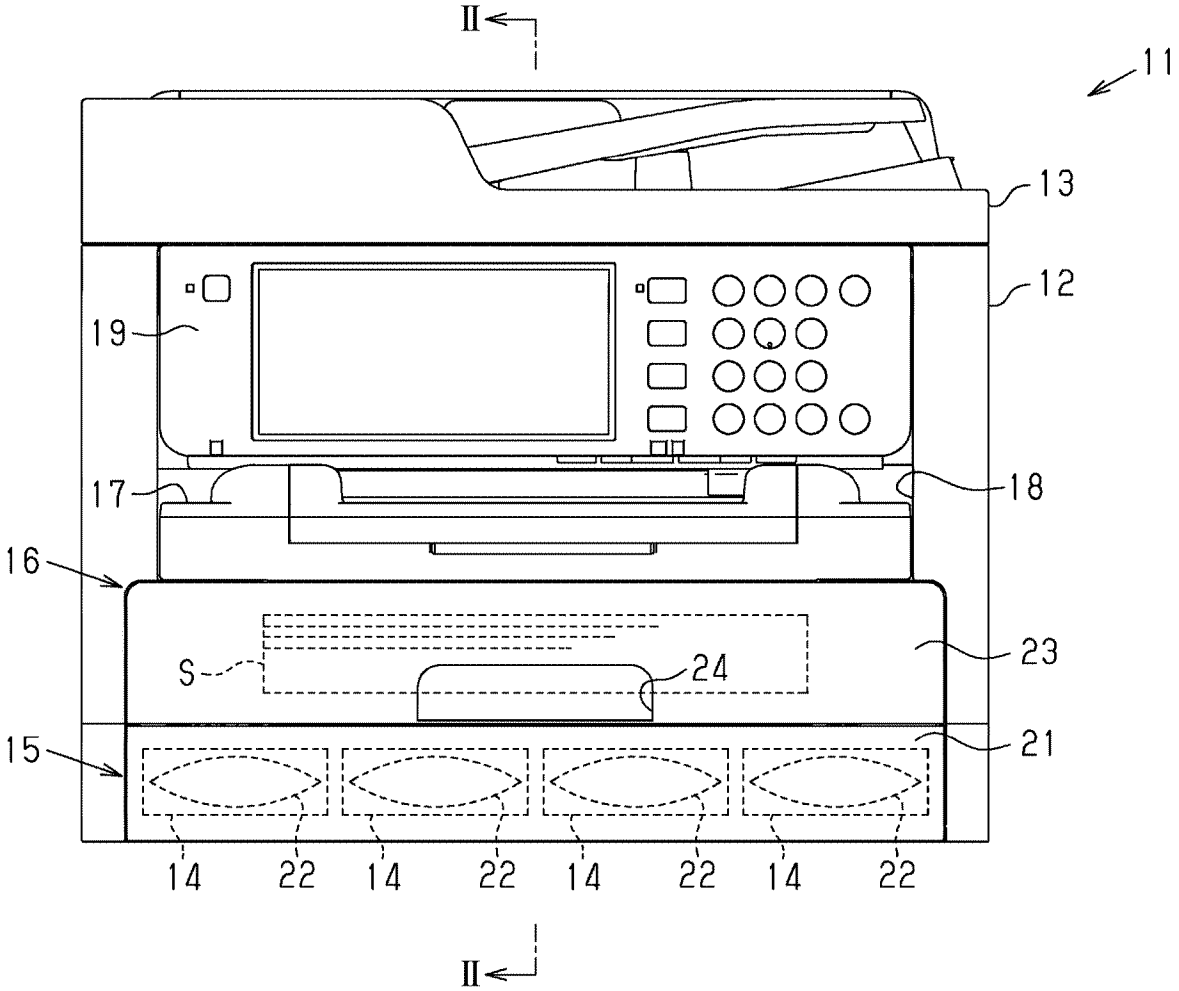
FIG. 1 is a front view schematically illustrating a printing apparatus according to an embodiment.

Hereinafter, an embodiment of an ink jet printer, which is an example printing apparatus, will be described with reference to the drawings. As illustrated in FIG. 1, a printing apparatus 11 includes a substantially rectangular parallelepiped apparatus body 12 and a reading unit 13 that is attached to an upper portion of the apparatus body 12. The reading unit 13 can read characters and an image such as a picture recorded on a document. The apparatus body 12 includes, in order from a bottom side that is a lower side in a length direction to an upper side, an attachment section 15 to which containers 14 are detachably attached and a medium storage section 16 that can store a medium S, for example, paper. On a front side of the apparatus body 12 and an upper side of the medium storage section 16, a discharge port 18 from which a discharge tray 17, on which a printed medium S is discharged, extends, and an operation section 19 that is used to operate the printing apparatus 11 are provided. The front side of the apparatus body 12 has a height and a width and is used mainly to operate the printing apparatus 11.

The attachment section 15 is covered with a rotatable front lid 21 that is a part of the front side of the apparatus body 12. To the attachment section 15, one or more (in this embodiment, four) containers 14 can be attached. To each container 14, a liquid container 22 that stores a liquid to be used by the printing apparatus 11 to perform printing onto the medium S is detachably attached. The liquid containers 22 respectively store different liquids, for example, different colors of inks such as a black ink, a cyan ink, a magenta ink, and a yellow ink. It should be noted that the container 14 can be detachably attached to the attachment section 15 without the liquid container 22. To the attachment section 15, the liquid container 22 may be directly attached without the container 14. In this embodiment, a width direction of the printing apparatus 11 is a direction that intersects a path of the movement of the container 14 when the container 14 is attached to the attachment section 15, and a depth direction of the printing apparatus 11 is a direction the movement path is extended.

To the medium storage section 16, a medium container 23 that can store the medium S is detachably attached. In other words, the medium container 23 is detachably attached to the apparatus body 12. In the medium container 23, the medium S that is to be used for printing by the printing apparatus 11 is stored. On a front side of the medium container 23, a handle section 24 is provided for users to hold it. The front side of the medium container 23 is a part of the front side of the apparatus body 12 when the medium container 23 is attached to the apparatus body 12. In this embodiment, the direction in which the movement path of the medium container 23 attached to the medium storage section 16 extends is the same as the direction in which the movement path of the container 14 attached to the attachment section 15 extends. Accordingly, the attachment direction in which the medium container 23 is attached to the apparatus body 12 corresponds to the depth direction of the printing apparatus 11. On the other hand, the detachment direction in which the medium container 23 is detached from the apparatus body 12 is opposite to the depth direction of the printing apparatus 11. Specifically, when the medium container 23 is attached to the apparatus body 12, the medium container 23 is moved from a side closer to the user, which is the front side of the printing apparatus 11, toward a side farther from the user, which is the back side of the printing apparatus 11. When the medium container 23 is detached from the apparatus body 12, the medium container 23 is moved from the side farther from the user toward the side closer to the user. In this embodiment, the detachment direction, the width direction, and the length direction in the printing apparatus 11 are different from each other.

Figure 2:
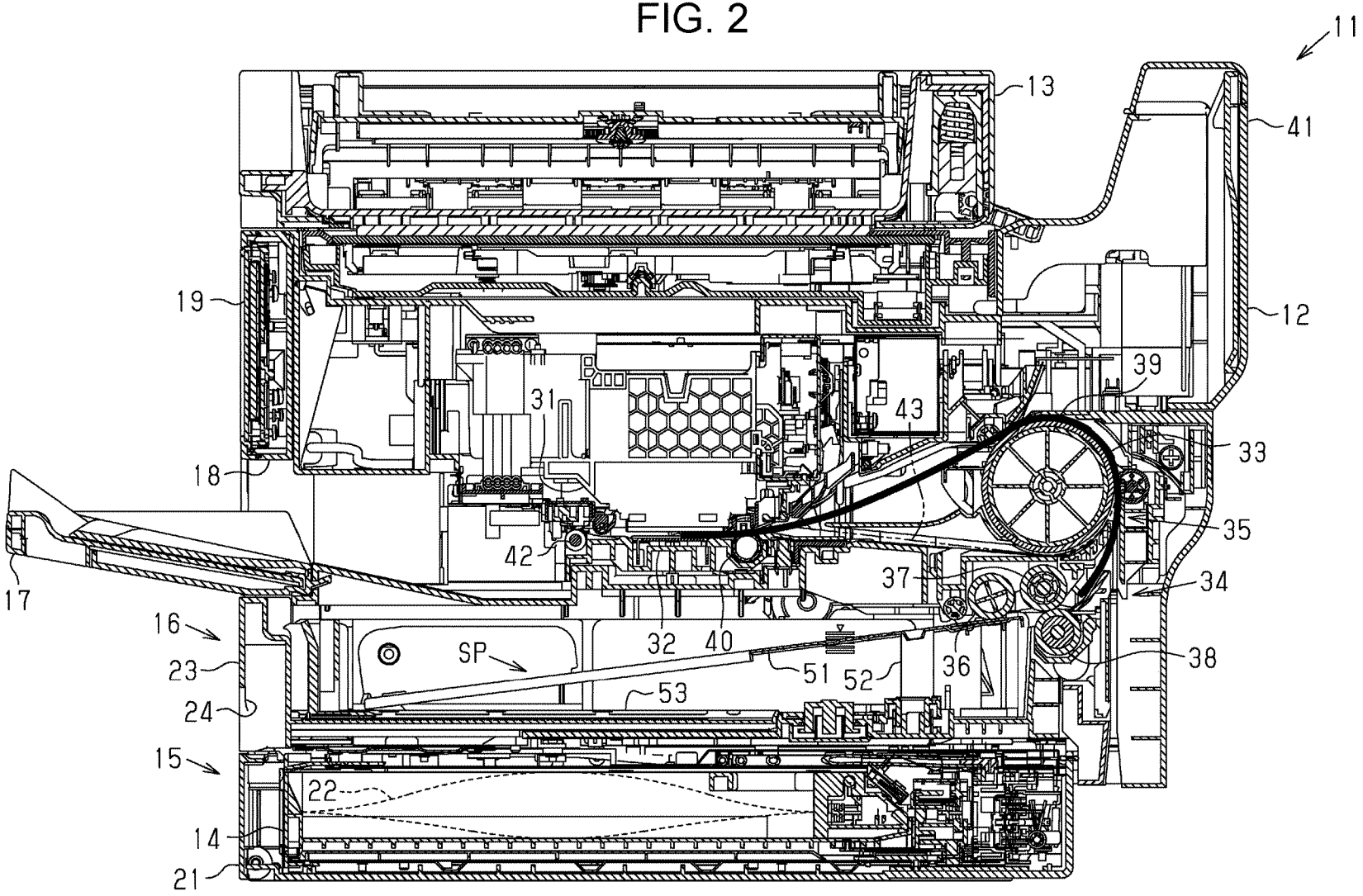
FIG. 2 is a cross-sectional view taken along the line II-II in FIG. 1.

As illustrated in FIG. 2, the apparatus body 12 includes a print section 31 and a medium support section 32 disposed above the medium storage section 16. The print section 31 is connected to the liquid containers 22, which are attached to the attachment section 15, by flow paths such as tubes and performs printing onto the medium S by using (discharging) the liquids supplied from the liquid containers 22. The medium support section 32 is disposed so as to face the print section 31 to support the medium S, on which printing is to be performed by the print section 31, from below.

The printing apparatus 11 includes a transport path 33, a sheet feeding section 34, and a transport section 35. The transport path 33 extends from the medium storage section 16 toward the print section 31 in the apparatus body 12. The sheet feeding section 34 feeds the medium S that is stored in the medium container 23 attached to the medium storage section 16 to the transport path 33. The transport section 35 transports the medium S that has been fed by the sheet feeding section 34 along the transport path 33. The transport path 33 extends upward from a position corresponding to the back section of the medium storage section 16 and is curved toward the front of the printing apparatus 11. The transport path 33 further extends to a position between the print section 31 and the medium support section 32.

The sheet feeding section 34 includes a pickup roller 36, a separation roller 37, and a retard roller 38. The pickup roller 36 comes into contact with the medium S from above when feeding the medium S stored in the medium container 23. The separation roller 37 and the retard roller 38 separate the media S fed by the pickup roller 36 one by one. The separation roller 37 and the retard roller 38 are disposed on a downstream side of the pickup roller 36 and the separation roller 37 and the retard roller 38 face each other such that the medium S is to be nipped therebetween. The separation roller 37 comes into contact with a surface of the medium S with which the pickup roller 36 also comes into contact, and the retard roller 38 comes into contact with a surface on the opposite side. The retard roller 38 rotates with the rotation of the separation roller 37. The retard roller 38 has a coefficient of friction with respect to the medium S larger than that of the separation roller 37. The separation roller 37 and the retard roller 38 separate the medium S one by one using the difference between the coefficients of friction.

The transport section 35 is disposed on the downstream side of the separation roller 37 in the transport path 33 and includes a plurality of rollers that are disposed along the transport path 33. In this embodiment, the feed roller 39 and the transport roller 40 are disposed in this order from the upstream side in the transport path 33. The transport section 35 may include rollers other than the feed roller 39 and the transport roller 40.

The feed roller 39 is disposed over the separation roller 37 in this embodiment. The feed roller 39 transports forward the medium S that has been fed by the sheet feeding section 34 while bending the medium S from above along the transport path 33. The feed roller 39 may transport forward the medium S that is manually fed through a manual feeding section 41 that is disposed at an upper portion on the back side of the apparatus body 12. The transport roller 40 is disposed on the downstream side in the transport path 33 such that the transport roller 40 is adjacent to the medium support section 32. The transport roller 40 transports forward the medium S that has been transported by the feed roller 39 along the transport path 33.

The transport section 35 transports the medium S, which has been fed from the medium storage section 16 by the pickup roller 36, above the medium support section 32 that is disposed on the downstream side in the transport path 33. The medium S is fed from the medium storage section 16 toward the back side and transported forward toward the medium support section 32 while being bent, and thereby the orientation of the medium S is reversed upside down from the orientation of the medium S that is placed in the medium storage section 16 to the orientation of the medium S that is placed on the medium support section 32. The width direction of the medium S being transported corresponds to the width direction of the printing apparatus 11. After printing onto the medium S by the print section 31 has completed, the medium S is discharged by a discharge section 42 that is disposed on the downstream side of the print section 31 in the apparatus body 12 toward a discharge tray 17.

The transport roller 40 can rotate in both forward rotation direction and reverse rotation direction. To perform printing on both sides of the medium, printing is performed on one side of the medium S and the printed medium S is reversely transported by the transport roller 40 that rotates reversely. In this operation, the medium S is transported on a two-sided printing path 43, which is different from the transport path 33. The two-sided printing path 43 extends in the apparatus body 12 from a position of the transport roller 40 toward a position under the feed roller 39. The medium S that has been transported on the two-sided printing path 43 is returned onto the transport path 33 and transported toward the print section 31 while the orientation is reversed.

The medium container 23 that is attached to the medium storage section 16 includes a hopper 51 that presses upward the medium S in the medium container 23 against the pickup roller 36. The hopper 51 is urged from the lower side to the upper side by an urging member 52 made of a spring or a rubber, for example. The urging member 52 is provided between the hopper 51 and a bottom wall 53 of the medium container 23 and located at a position closer to the side farther from the user in the depth direction. The hopper 51 can turn on a fulcrum, which is a point (for example, a pin 64 described below) closer to the side closer to the user in the depth direction, and is urged upward by the urging member 52 such that an end portion on the side farther from the user is lifted. In other words, the end portion of the medium S, which is stored in the medium container 23, on the side farther from the user is lifted by the hopper 51 and pressed downward by the pickup roller 36. The medium S that is pressed upward by the hopper 51 in the medium container 23 is fed by the rotation of the pickup roller 36 from the medium container 23.

The hopper 51 according to the embodiment can move upward and downward between a feeding position SP where the end portion of the medium S on the side farther from the user in the depth direction is located at an upper position and a waiting position WP (see FIG. 3) where the end portion of the medium S is located at a lower position along the bottom wall 53 of the medium container 23. The hopper 51 in FIG. 2 is positioned at the feeding position SP. At the feeding position SP, the medium S stored in the medium container 23 is pressed against the pickup roller 36. The urging member 52 always urges upward the hopper 51 so as to be positioned at the feeding position SP.

Figure 3:
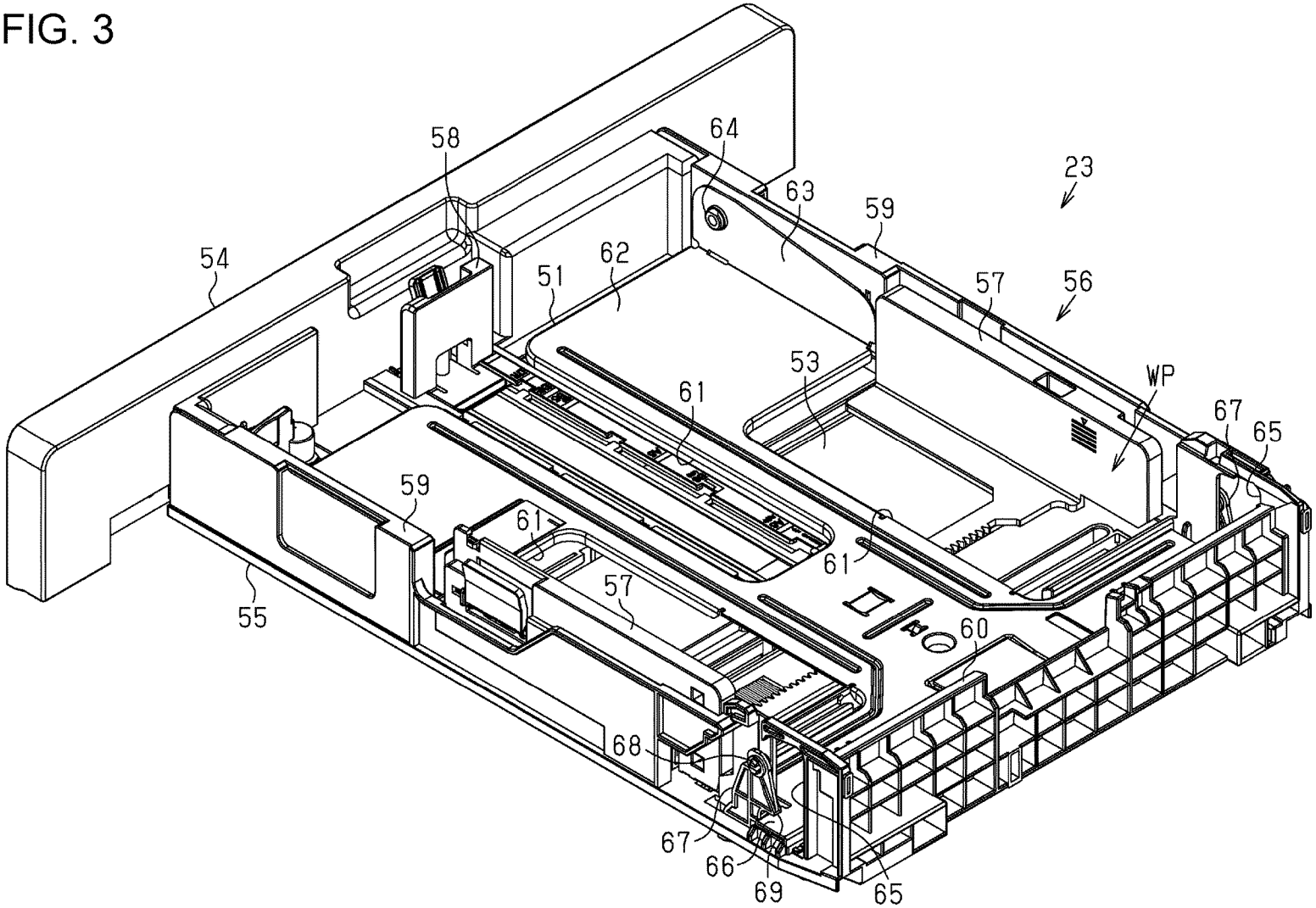
FIG. 3 is a perspective view illustrating a medium container.

As illustrated in FIG. 3, the medium container 23 includes an operation panel 54 that has the handle section 24 and a case 55 that is attached to the operation panel 54. The operation panel 54 is used to move the medium container 23 by a user by holding the handle section 24 to attach the medium container 23 to the apparatus body 12 or detach the medium container 23 from the apparatus body 12. The plate-shaped operation panel 54 extends in the width direction and the width is longer than that of the case 55. The case 55 has a box shape with an open upper portion, and the medium S can be stored in the case 55. The case 55 is attached to a back side of the operation panel 54, which is an opposite side of the front side on which the handle section 24 is provided. The case 55 extends from the back side of the operation panel 54 toward the side farther from the user in the depth direction.

The case 55 includes an edge guide 56 that comes into contact with edge portions of the stored medium S to guide the medium S in the case 55. The edge guide 56 extends upward from the bottom wall 53 of the case 55. The edge guide 56 according to the embodiment includes a pair of side edge guides 57 that can be brought into contact with the both sides of the stored medium S in the width direction and a rear edge guide 58 that can be brought into contact with a rear end, which is on the side closer to the user in the depth direction, of the medium S. The side edge guides 57 are placed face-to-face in the width direction along parts of side walls 59, which are parts of a peripheral wall of the case 55 and placed at both ends of the case 55 in the width direction. The side edge guides 57 can be moved in the width direction in conjunction with each other. The distance between the facing side edge guides 57 can be changed. In other words, the side edge guides 57 can be moved in the width direction in accordance with the width of the stored medium S.

The rear edge guide 58 is placed at a position in a central portion of the case 55 in the width direction on the side closer to the user in the depth direction along a part of the back side of the operation panel 54. The rear edge guide 58 can be moved in the depth direction and the distance between the rear edge guide 58 and a side wall 60, which is a part of the peripheral wall of the case 55 and located on the side farther from the user in the depth direction, can be changed. In other words, the rear edge guide 58 can be moved in the depth direction in accordance with the length of the stored medium S in the depth direction. The end portions of the medium S that is stored in the medium container 23 are surrounded and guided in the case 55 by the side wall 60, which is located on the side farther from the user in the depth direction in the case 55, a pair of side edge guides 57, and the rear edge guide 58.

The case 55 includes the hopper 51 that presses upward the medium S that is stored in the case 55. The hopper 51 illustrated in FIG. 3 is positioned at the waiting position WP and the hopper 51 is placed along the bottom wall 53 of the case 55, which is the bottom wall 53 of the medium container 23. The waiting position WP is a position for preventing the stored medium S from interfering with the other members when the medium container 23 is attached to the apparatus body 12. The hopper 51 that supports the medium S from below has a plurality of notches to ensure movement areas of the edge guide 56. In other words, a part of the bottom wall 53 of the case 55 is exposed through the notches 61.

The hopper 51 includes bent pieces 63 that are bent upward from a support surface 62, which supports the medium S, at both ends of the hopper 51 in the width direction on the side closer to the user in the depth direction. The hopper 51 is disposed such that the bent pieces 63 are along the side walls 59 of the case 55 in the width direction. In the hopper 51, portions of the bent pieces 63 on the side closer to the user in the depth direction are attached to the side walls 59 of the case 55 with the pins 64. In short, the hopper 51 turns about the pins 64 and thereby the hopper 51 moves between the feeding position SP and the waiting position WP.

The hopper 51 has edge portions 66 at both ends of the hopper 51 in the width direction on the side farther from the user in the depth direction. The edge portions 66 are inserted into guide holes 65 that are open on the side walls 59 of the case 55 in the width direction. The guide holes 65 are open at portions on the side walls 59 on the side farther from the user in the depth direction to extend in the length direction. Specifically, the edge portions 66 of the hopper 51 move upward and downward along the guide holes 65 when the hopper 51 is moved between the feeding position SP and the waiting position WP. In short, the guide holes 65 guide the movement of the hopper 51 via the edge portions 66. Each of the edge portions 66 is located at an upper portion of the guide hole 65 when the hopper 51 is positioned at the feeding position SP and located at a lower portion of the guide hole 65 when the hopper 51 is positioned at the waiting position WP.

Figure 4:
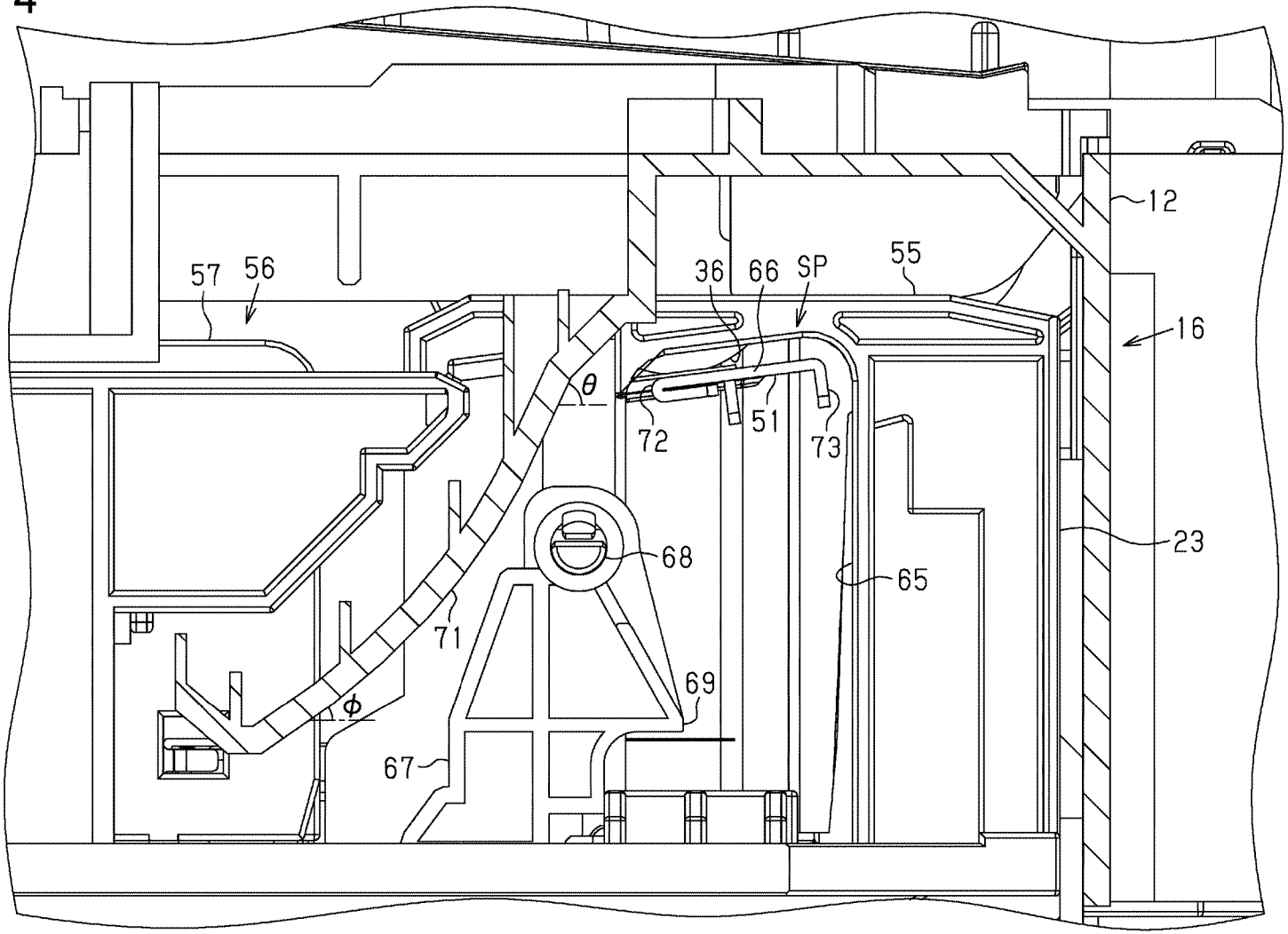
FIG. 4 is a cross-sectional view illustrating a section in which a guide surface is provided in the printing apparatus.

As illustrated in FIG. 3 and FIG. 4, the medium container 23 includes lock sections 67 that can lock the hopper 51 at the waiting position WP. The lock sections 67 are disposed adjacent to the guide holes 65, which are open on the side walls 59 of the case 55, and attached to the side walls 59 with pins 68. The lock sections 67 are disposed on the side closer to the user than the guide holes 65 in the depth direction outside the side walls 59 in the width direction. The lock sections 67 have hooks 69 that can be engaged with the edge portions 66 of the hopper 51 at the waiting position WP. A tip of the hook 69 extends from the side closer to the user in the depth direction to overlap the guide hole 65 viewed in the width direction.

The lock sections 67 can be rotated about the pins 68. The lock sections 67 can be rotated about the pins 68 to move between a lock position where the hopper 51 positioned at the waiting position WP is locked and a lock release position where the lock is released. The lock sections 67 illustrated in FIG. 3 and FIG. 4 are positioned at the lock position. The lock sections 67 are always urged by a torsion spring (not illustrated) such that the hooks 69 are positioned at the lock positions where the hooks 69 overlap with the guide holes 65. In short, the lock sections 67 according to the embodiment are urged by a torsion spring (not illustrated) about the pins 68 in the counterclockwise direction in FIG. 4 such that the hooks 69 are moved toward the side farther from the user in the depth direction.

Here, it is assumed that the hopper 51 is switched from the feeding position SP to the waiting position WP. The hopper 51 is moved downward from the feeding position SP and then the edge portions 66, which are parts of the hopper 51, are moved downward along the guide holes 65 to come into contact with the hooks 69, which overlap with the guide holes 65, of the lock sections 67. The hopper 51 is further moved downward and the edge portions 66 are moved downward along the guide holes 65 to push the hooks 69 of the lock sections 67. During the process, the lock sections 67 turn about the pins 68 in the clockwise direction in FIG. 4 such that the hooks 69 are moved to the side closer to the user in the depth direction in response to the contact of the edge portions 66. The edge portions 66 are moved downward to move over the hooks 69 and reach the waiting position WP. Then, the lock sections 67 return to the lock position by the urging force of the torsion spring (not illustrated) to lock the hopper 51 that is at the waiting position WP to prevent the hopper 51 from moving upward. The hopper 51 that has been locked by the lock sections 67 is released by turning the lock sections 67 such that the hooks 69 are moved toward the side closer to the user in the depth direction against the urging force of the torsion spring. In short, the lock sections 67 are turned about the pins 68 such that the hooks 69 are moved toward the side closer to the user in the depth direction, and the position corresponds to the lock release position.

As illustrated in FIG. 4, a guide surface 71 is provided at a position where the side walls 59 of the case 55, which are parts of the medium container 23, in the width direction face in a state where the medium container 23 is attached to the medium storage section 16, which is a part of the apparatus body 12. The edge portions 66, which are parts of the hopper 51, come into contact with the guide surface 71 from the side farther from the user in the detachment direction when the medium container 23 is detached from the apparatus body 12. The guide surface 71 is disposed at a position on the side closer to the user than the edge portions 66 in the depth direction in a state in which the medium container 23 is attached to the apparatus body 12. The guide surface 71 is curved and extended downward from the side farther from the user toward the side closer to the user in the depth direction. The guide surface 71 extends in the detachment direction of the medium container 23, the detachment direction is opposite to the depth direction of the printing apparatus 11, so as to make a downward acute angle toward the side closer to the user with respect to a virtual direction that extends in the detachment direction.

In the detachment direction, the guide surface 71 has a smaller angle at the end portion on the side closer to the user than an angle at the end portion on the side farther from the user with respect to the virtual line extending in the detachment direction. An angle of the guide surface 71 with respect to the virtual line extending in the detachment direction is defined on the premise that an angle between the guide surface 71 and the surface extending in the same direction as the detachment direction is 0°. Specifically, if an angle of the guide surface 71 with respect to the virtual line extending in the detachment direction at an end portion on the side farther from the user is an angle θ and an angle at an end portion on the side closer to the user is an angle φ, the relationship between the angles is defined as θ>φ. The guide surface 71 according to the embodiment is curved in an arc shape such that the angles of the guide surface 71 with respect to the virtual line extending in the detachment direction are gradually decreased from the side farther from the user toward the side closer to the user.

To detach or attach the medium container 23 from or to the apparatus body 12, portions of the edge portions 66 on the side closer to the user in the depth direction come into contact with the guide surface 71. The portions of the edge portion 66 on the side closer to the user are curved surfaces 72 that are curved with respect to the guide surface 71. Each of the curved surfaces 72 is formed by hemming a part of the plate-shaped hopper 51. At the other portion of the edge portions 66 on the side farther from the user opposite to the hemmed portions on the side closer to the user, a bent portion 73 where a part of the hopper 51 is bent in an L shape in the width direction is provided. The bent portion 73 increases the stiffness of the hopper 51.

Figure 5:
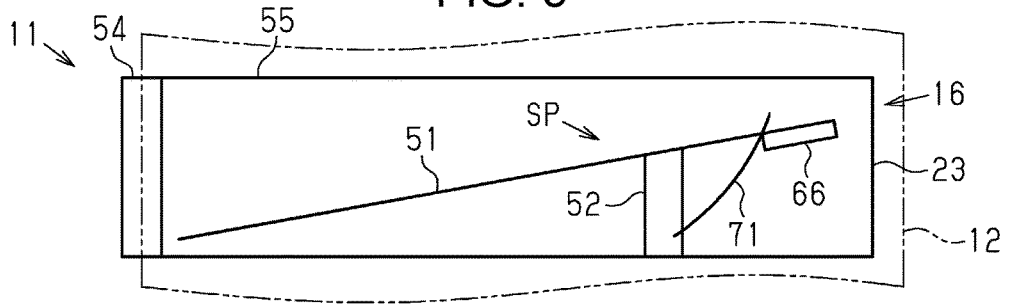
FIG. 5 is a schematic side view of a medium container that is started to be detached.
Figure 6:
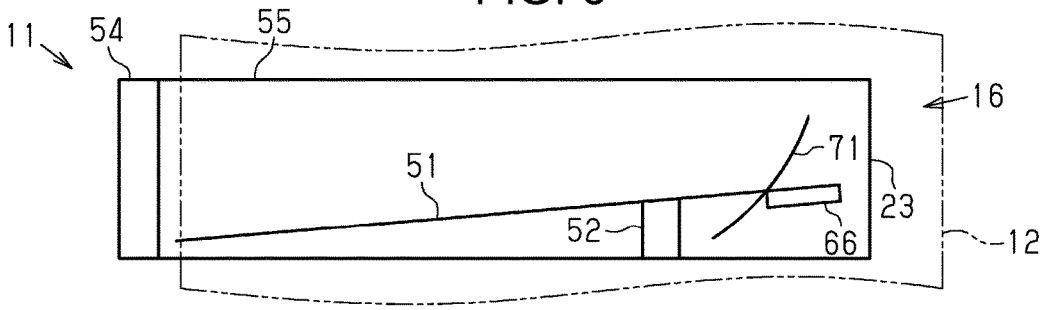
FIG. 6 is a schematic side view of the medium container that is further pulled out from the state in FIG. 5.
Figure 7:
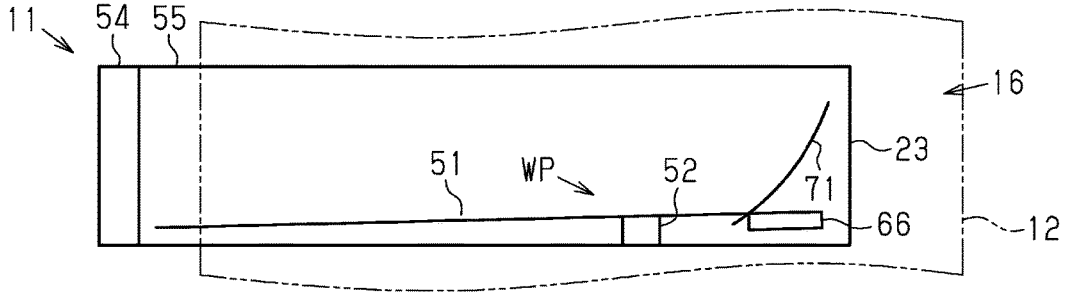
FIG. 7 is a schematic side view of the medium container that is further pulled out from the state in FIG. 6.

Next, an operation of the printing apparatus 11 having the above-described structure will be described. As illustrated in FIG. 5, FIG. 6, and FIG. 7, as the medium container 23 is detached from the apparatus body 12 in the detachment direction, due to the urging force by the urging member 52, the edge portions 66 of the hopper 51 that is positioned at the feeding position SP come into contact with the end portion of the guide surface 71 on the side farther from the user in the detachment direction. From the state in which the edge portions 66 are in contact with the guide surface 71, as the medium container 23 is further pulled out in the detachment direction, the hopper 51 is gradually moved downward from the feeding position SP toward the waiting position WP while the edge portions 66 are guided to slide on the guide surface 71 against the urging force by the urging member 52. The medium container 23 is further pulled out in the detachment direction and the hopper 51 is positioned at the waiting position WP while the edge portions 66 are guided by the guide surface 71, and thereby the medium container 23 is detached from the apparatus body 12.

In short, the printing apparatus 11 according to the embodiment enables the hopper 51 of the medium container 23 to be switched from the feeding position SP to the waiting position WP in conjunction with the operation to detach the medium container 23 from the apparatus body 12 without using an electrical mechanism such as a controller and a sensor. To attach the medium container 23 to the apparatus body 12, the lock sections 67 are turned to the lock release positions by a lock release member (not illustrated) that is provided in the apparatus body 12 in conjunction with the operation of attaching the medium container 23. The unlocked hopper 51 is moved upward by the urging force of the urging member 52 to move from the waiting position WP to the feeding position SP while the edge portions 66 slide on the guide surface 71.

According to the above-described embodiment, the following advantages can be achieved.

1. When the medium container 23 is detached from the apparatus body 12 to the side closer to the user, the portions of the hopper 51 on the side farther from the user than the fulcrum of the hopper 51 come into contact with the guide surface 71 from the side farther from the user and the portions of the hopper 51 slide on the guide surface 71 while the medium container 23 is detached. Consequently, as the medium container 23 is pulled out from the apparatus body 12 toward the side closer to the user, the hopper 51 can be moved downward against the urging force of the urging member 52 by the guide surface 71 that makes a downward angle toward the side closer to the user with respect to the detachment direction. With this simple structure, the hopper 51 can be moved.

2. In general, the urging member 52 made of a spring, a rubber or the like has a larger urging force (reaction force) as the compression amount increases. In this embodiment, as the medium container 23 is pulled out from the apparatus body 12, the position of the hopper 51 is lowered and this causes the urging member 52 to increase its compressing force and thereby the urging force increases. As the urging force of the urging member 52 increases, a larger force is required to lower the hopper 51. Consequently, the force required to detach the medium container 23 gradually increases as the amount of detachment increases.

In this regard, in the detachment direction, the guide surface 71 according to the embodiment has a larger angle with respect to the detachment direction at the end portion on the side farther from the user than that at the end portion on the side closer to the user. Accordingly, when the medium container 23 is detached from the apparatus body 12, as the detachment amount of the medium container 23 in the detachment direction increases, the amount of descent of the hopper 51, which is lowered while the edge portions 66 are guided by the guide surface 71, decreases. In other word, as the compression amount by the urging member 52 increases, the descent amount of the hopper 51 to the detachment amount of the medium container 23 decreases.

As a result, the tip portion of the hopper 51 can be quickly lowered by a predetermined force at the stage where the urging force of the urging member 52 is relatively small and the detachment amount of the medium container 23 is small. On the other hand, the tip portion of the hopper 51 can be slowly lowered by the same degree of force as the predetermined force at the stage where the urging force of the urging member 52 is relatively large and the detachment amount of the medium container 23 is large. In short, the force required to detach the medium container 23 can be smoothed without increasing the stroke of detaching the medium container 23 from the apparatus body 12.

3. The guide surface 71 is provided such that angles with respect to the detachment direction are gradually decreased in the detachment direction from the side farther from the user toward the side closer to the user. With this structure, the force required to detach the medium container 23 can be further smoothed.

4. The curved surfaces 72, which are curved with respect to the guide surface 71, are provided at the portions of the edge portions 66 where the edge portions 66 come into contact with the guide surface 71. With this structure, the friction produced when the edge portions 66 come into contact with the guide surface 71 can be reduced.

The above-described embodiment can be modified as described below. It should be noted that the following modifications may be combined as appropriate.

Figure 8:
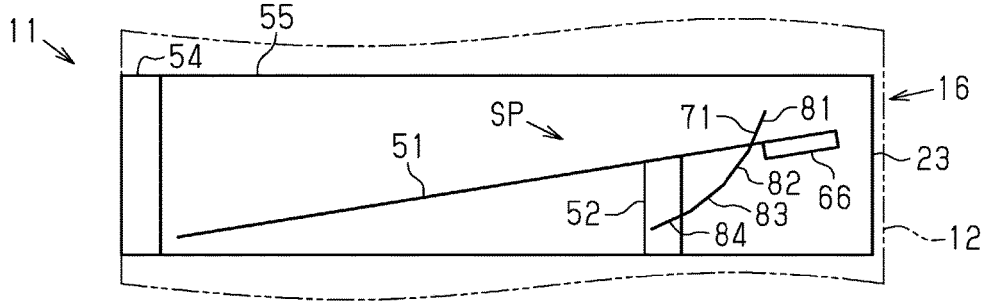
FIG. 8 is a side view illustrating a modification of the medium container.

As illustrated in FIG. 8, the guide surface 71 may be made such that a plurality of linearly extending surfaces are continuous from the side farther from the user to the side closer to the user in the detachment direction. In this modification, the guide surface 71 has continuous four surfaces including a first surface 81, a second surface 82, a third surface 83, and a fourth surface 84 in this order from the side farther from the user in the detachment direction.

Angles of the surfaces 81, 82, 83, and 84 with respect to the detachment direction are decreased in this order from the first surface 81.

According to this modification, in addition to the advantages according to the above-described embodiment, the following advantages can be achieved:

5. The guide surface 71 can be formed more easily than the arc-shaped guide surface 71.

The urging member 52 that urges the hopper 51 from below may be disposed so as to urge a central part of the hopper 51 in the detachment direction.

The medium container 23 may omit the edge guide 56.

The hopper 51 may be attached to the case 55 by a hinge at an end portion on the side closer to the user in the detachment direction.

In the medium container 23, the operation panel 54 and the case 55 may be integrally formed.

The medium S to be stored in the medium container 23 is not limited to paper and alternatively, for example, a plastic film or cloth may be used.

The printing apparatus may be a fluid ejection apparatus that ejects or discharges a fluid (for example, a liquid, a liquid material containing particles of a functional material dispersed or mixed in a liquid, a fluid material such as a gel, and a solid that can be ejected as a fluid) other than inks for printing. For example, the printing apparatus may be a liquid material ejecting apparatus that ejects a liquid material containing a dispersed or dissolved material such as an electrode material or a color material (pixel material) used for manufacturing liquid crystal displays, electroluminescence (EL) displays, or field emission displays (FEDs) for printing. The printing apparatus may be a fluid material ejecting apparatus that ejects a fluid material such as a gel (for example, a physical gel), or a powder and granular material ejecting apparatus (for example, a toner jet type recording apparatus) that ejects a solid, for example a powder (powder and granular material) such as a toner. The present invention can be applied to any one of the fluid ejecting apparatuses. In this specification, "fluid" includes, for example, liquids (including inorganic solvents, organic solvents, solutions, liquid resins, liquid metals (metallic melts) and the like), liquid materials, fluid materials, and powder and granular materials (including grains and powders).

The entire disclosure of Japanese Patent Application No. 2016-254410, filed Dec. 27, 2016 is expressly incorporated by reference herein.

What is claimed is:

1. A printing apparatus comprising:

an apparatus body;

a print section configured to perform printing on a medium;

a medium container that is detachably attached to the apparatus body, the medium container being capable of storing the medium; and a pickup roller configured to come into contact with the medium when the medium is fed from the medium container attached to the apparatus body, wherein the medium container can be detached by being pulled out from the apparatus body to a side closer to a user and includes a hopper configured to press the stored medium against the pickup roller, the hopper is turned on a portion on the side closer to the user as a fulcrum with respect to the direction of detachment from the apparatus body and is pressed by a pressing member against the pickup roller such that a portion on a side farther from the user is lifted with respect to the detachment direction, the apparatus body includes a guide surface with which a part of the hopper comes into contact, the guide surface being configured to press down the hopper against the pressure by the pressing member as the medium container attached to the apparatus body is detached from the apparatus body, wherein the guide surface has an inclined portion inclined in a downward angle toward the detachment direction of the medium container, and wherein the inclined portion has plural angles with respect to a virtual line in the detachment direction of the medium container.

2. The printing apparatus according to claim 1, wherein the inclined portion is provided in such a manner that the plural angles with respect to the detachment direction are gradually decreased.

3. The printing apparatus according to claim 1, wherein the inclined portion is formed by plural planes.

4. The printing apparatus according to claim 1, wherein the hopper has edge portions that can be brought into contact with the guide surface at both ends in a width direction that is different from the detachment direction and a length direction, and the edge portions have curved sections at the portions to be brought into contact with the guide surface.

* * * * *